US006846188B2

(12) United States Patent
Hsin et al.

(10) Patent No.: US 6,846,188 B2
(45) Date of Patent: Jan. 25, 2005

(54) RIGHT ANGLE CABLE END CONNECTOR ASSEMBLY AND THE METHOD OF MAKING THE SAME

(75) Inventors: Huang Hsin, Tu-Chen (TW); Jie Cheng, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/617,056

(22) Filed: Jul. 9, 2003

(65) Prior Publication Data

US 2004/0224540 A1 Nov. 11, 2004

(30) Foreign Application Priority Data

May 7, 2003 (TW) ..... 092112494

(51) Int. Cl.[7] ..... H01R 12/00; H01R 13/58
(52) U.S. Cl. ..... 439/79; 439/455; 439/460
(58) Field of Search ..... 439/79, 449, 452–456, 439/459–460, 463

(56) References Cited

U.S. PATENT DOCUMENTS 5,551,892 A * 9/1996 Endo et al. ..... 439/587
6,123,568 A 9/2000 Bullough et al.
6,325,661 B1 12/2001 Tabata ..... 439/459
6,616,477 B1 * 9/2003 Chang ..... 439/465

FOREIGN PATENT DOCUMENTS

CN 2508428 Y 8/2002

* cited by examiner

*Primary Examiner*—Michael C. Zarroli
(74) *Attorney, Agent, or Firm*—Wei Te Chung

(57) ABSTRACT

A cable end connector assembly (1) includes an insulative housing (10), a number of contacts (20), a cable (40), a casing (50) and a cover (60). The insulative housing includes a rear portion. The contacts are received in the insulative housing. The cable includes a number of conductive cores (41) electrically connected with the contacts respectively and an insulative jacket (43) surrounding and separating the conductive cores. The casing is molded with a connection between the contacts and the cable. The cable is bent along a rear edge of the casing. The cover is over-molded with the rear portion of the insulative housing, the casing and the cable. A method for making such a cable end connector assembly is also disclosed.

13 Claims, 7 Drawing Sheets

RIGHT ANGLE CABLE END CONNECTOR ASSEMBLY AND THE METHOD OF MAKING THE SAME

BACKGROUND OF THE INVENTION

1. Field of the Invention

The present invention relates to a cable end connector assembly and a method for making the same, and more particularly to a right angle Serial ATA (Advanced Technology Attachment) cable end connector assembly and a method for making the right angle Serial ATA cable end connector assembly.

2. Description of the Related Art

There exists in the art an electrical connector assembly known as a Serial ATA cable end connector assembly which is generally used for transmitting high speed signals between storage devices and a motherboard. Because of many advantages superior to Parallel ATA, Serial ATA is replacing Parallel ATA and becomes the next transmitting generation.

Chinese Patent No. 01222349.2 discloses a right angle Serial ATA cable end connector assembly. The assembly includes an insulative housing, a number of angled contacts disposed in the insulative housing, a cable electrically connected with the contacts, and an angled cover over-molded with a rear portion of the insulative housing and a front end of the cable. However, troubles will be encountered in mating/unmating the assembly with/from a complementary connector mounted on the motherboard or back panels of the storage devices and surrounded by many other electronic components because the assembly has a profile short in a mating direction along which the assembly is mated with the complementary connector. Thus, a Serial ATA cable end connector assembly relatively long in the mating direction is required to resolve the problem.

One of the approaches is to elongate the housing and the contacts of the assembly. However, if so, the original housing and contacts can not be used any more, and the mold for the housing and the die for the contacts also have to be redesigned, thereby inevitably increasing the production cost. In addition, the elongated contacts will make the process of assembling the contacts into the insulative housing complicated, because the elongated contacts are more readily undesirably deformed or bent on suffering from an inappropriate operation in comparison with the original size contacts.

Hence, an improved cable end connector assembly is required to overcome the disadvantages of the prior art.

SUMMARY OF THE INVENTION

A major object of the present invention is to provide a cable end connector assembly, which has a long profile in the mating direction along which the assembly is mated with a complementary connector, whereby the cable end connector assembly can be conveniently and readily mated/unmated with/from the complementary connector.

Another object of the present invention is to provide a cable end connector assembly, which is cost efficient and simply assembled.

A further object of the present invention is to provide a method for making a right angle cable end connector assembly having a long profile in the mating direction along which the assembly is mated with the complementary connector.

In order to achieve the object set forth, a cable end connector assembly comprises an insulative housing, a plurality of contacts, a cable, a casing and a cover. The insulative housing comprises a rear portion. The contacts are received in the insulative housing. The cable comprises a plurality of conductive cores electrically connected with the contacts respectively and an insulative jacket surrounding and separating the conductive cores. The casing is molded with a connection area between the contacts and the cable. The cable is then bent along a rear edge of the casing. The cover is over-molded with the rear portion of the insulative housing, the casing and the cable.

Other objects, advantages and novel features of the invention will become more apparent from the following detailed description when taken in conjunction with the accompanying drawings.

DETAILED DESCRIPTION OF THE INVENTION

Figure 1:
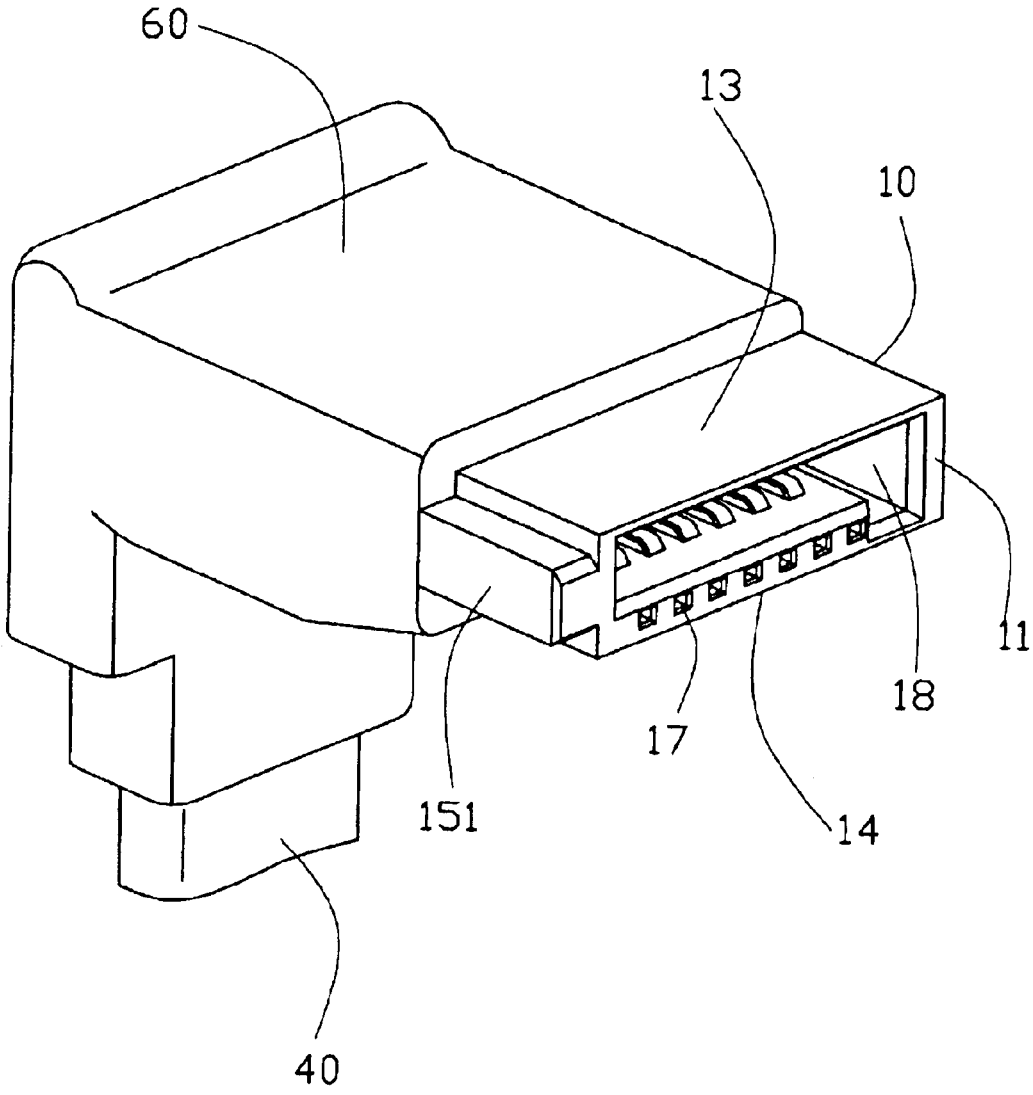
FIG. 1 is a perspective view of a cable end connector assembly in accordance with the present invention.
Figure 2:
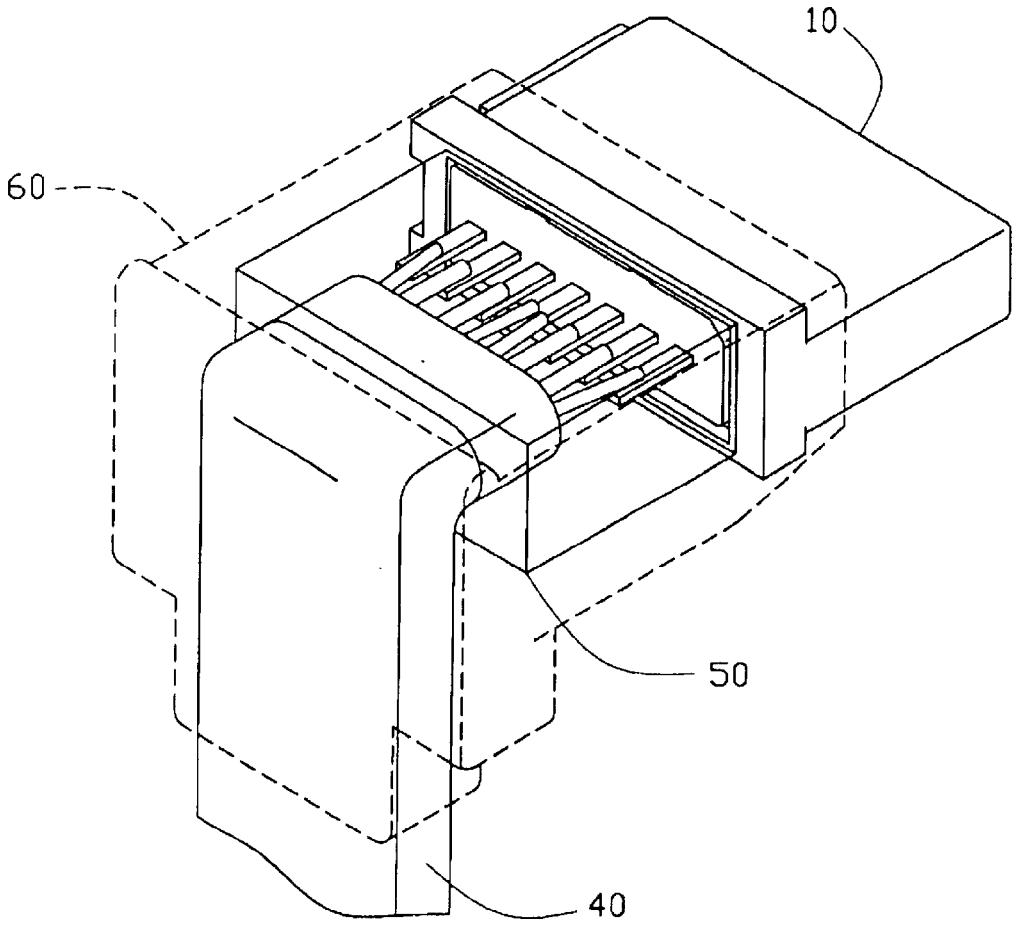
FIG. 2 is a perspective view of the cable end connector assembly of FIG. 1 taken from another aspect, wherein a cover thereof is shown in dotted line for clarity.
Figure 3:
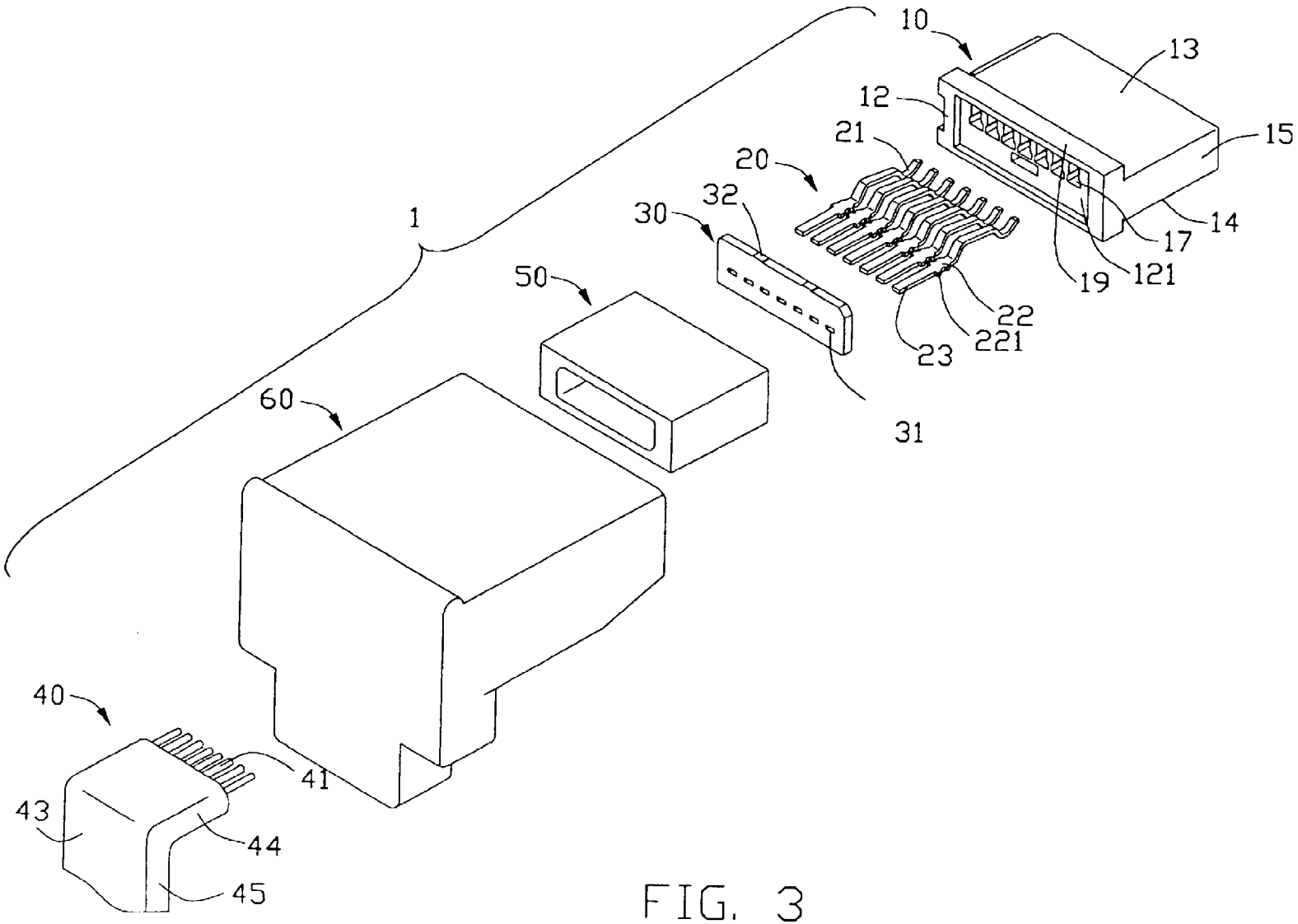
FIG. 3 is an exploded, perspective view of the cable end connector assembly of FIG. 2.

Referring to FIGS. 1 to 3, a cable end connector assembly 1 comprises an insulative housing 10, a plurality of contacts 20, a spacer 30, a cable 40, a casing 50 and a cover 60.

The insulative housing 10 comprises a front end 11, a rear end 12, opposite top and bottom walls 13, 14, and opposite side walls 15. The top, bottom and side walls together define an L-shaped receiving space 18 therebetween for receiving a mating portion of a complementary connector (not shown). The bottom wall 14 defines a plurality of passageways 17 extending through the front and the rear ends 11, 12. A block 151 projects sidewardly from an outer face of one of the side walls 15 for guiding the complementary connector. A plurality of ribs 19 project from outer faces of the top, bottom walls 13, 14 and one of the side walls 15 and are located at a rear portion of the insulative housing 10. A rectangular shaped cavity 121 is defined at the rear end 12.

The contacts 20 extend along the mating direction along which the assembly 1 is mated with the complementary connector. Each contact comprises a retention portion 22, a mating portion 21 extending forwardly from the retention portion 22, and a tail portion 23 extending rearwardly from the retention portion 22. Each retention portion 22 is formed with a plurality of barbs on a pair of sides thereof.

The spacer 30 is a rectangular plate and comprises a plurality of openings 31 defined therein and a pair of protrusions 32 formed on an upper edge thereof.

The cable 40 is bent at a right angle after the casing 50 is formed thereby forming a horizontal section 44 and a vertical section 45. The cable 40 comprises a plurality of conductive cores 41 and an insulative jacket 43 surrounding and separating the conductive cores 41.

The casing 50 is in the shape of a rectangular block, which is comprised of molded plastic, preferably transparent PE (Polyethylene, PE) material in this embodiment.

The cover 60 is configured to a right angle, which is also comprised of molded plastic, preferably PVC (Polyvinyl Chloride) in this embodiment.

Figure 4:
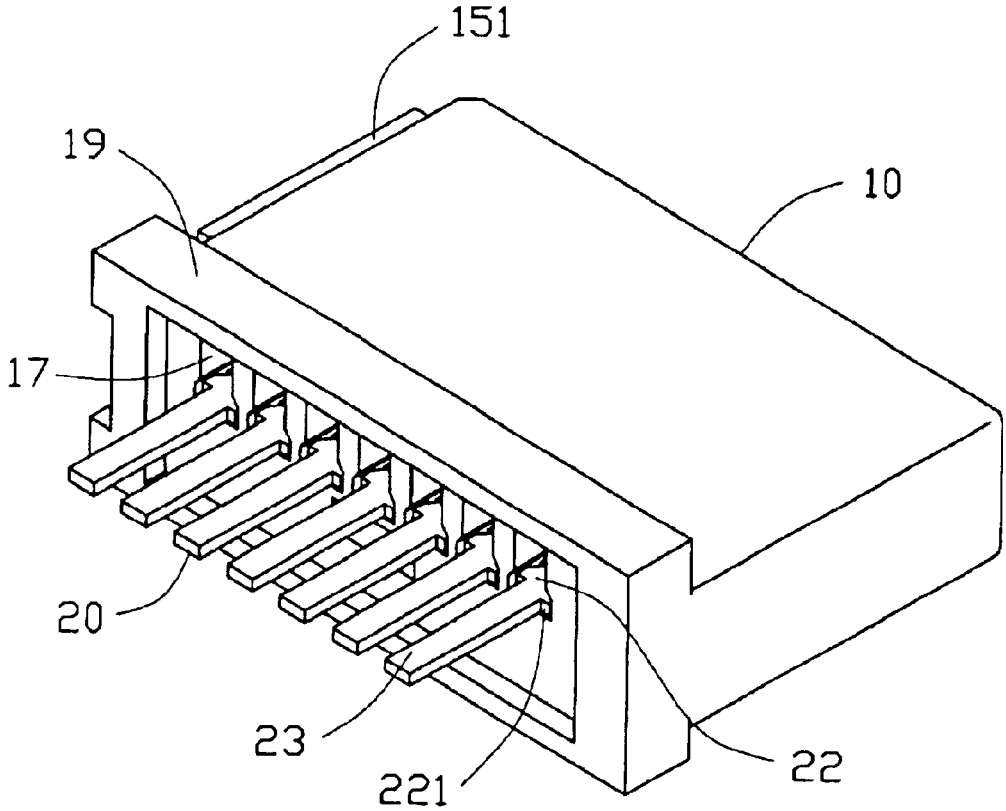
FIG. 4 is an assembled, perspective view of an insulative housing and contacts of the cable end connector assembly of FIG. 3.
Figure 5:
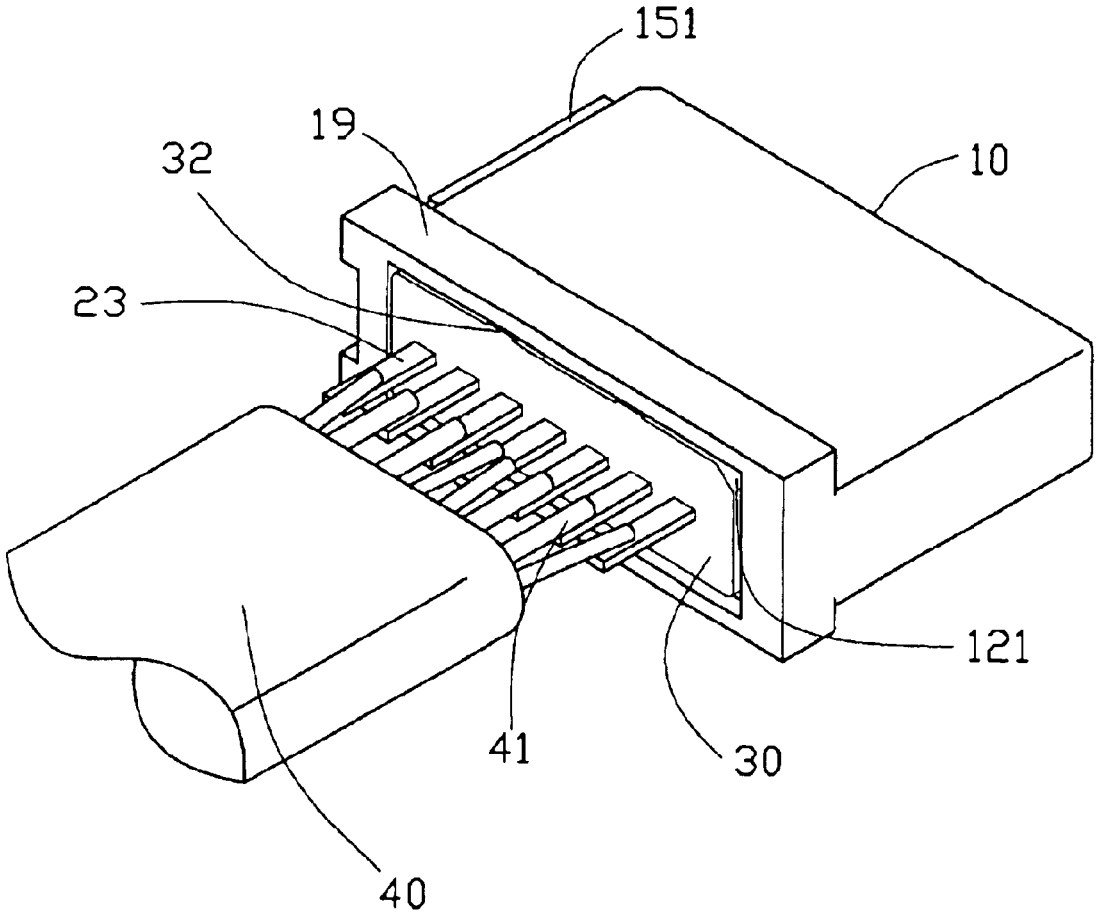
FIG. 5 is a view similar to FIG. 4, but a spacer is attached to the insulative housing, and a cable is connected with the contacts.

In processes of manufacturing and assembling, with reference to FIG. 4, the contacts 20 are inserted into the passageways 17 of the insulative housing 10. The mating portions 21 and the retention portions 22 are both received in the corresponding passageways 17 with the barbs 221 fittingly engaging with the side walls (not shown) of the passageways 17. The tail portions 23 extend out of the corresponding passageways 17 along the mating direction. With reference to FIG. 5, the spacer 30 is assembled in the cavity 121 of the insulative housing 10 with the openings 31 fittingly receiving the respective contacts 20 and the protrusions 32 snugly abutting against a top surface of the cavity 121 for securing the spacer 30 in the cavity 121. Thus, the spacer 30 seals one end of each passageway 17 so as to prevent the melted plastic material of the casing 50 and the cover 60 from entering into the housing 10 to influence the electrical connection between the cable end connector assembly 1 and the complementary connector.

Figure 6:
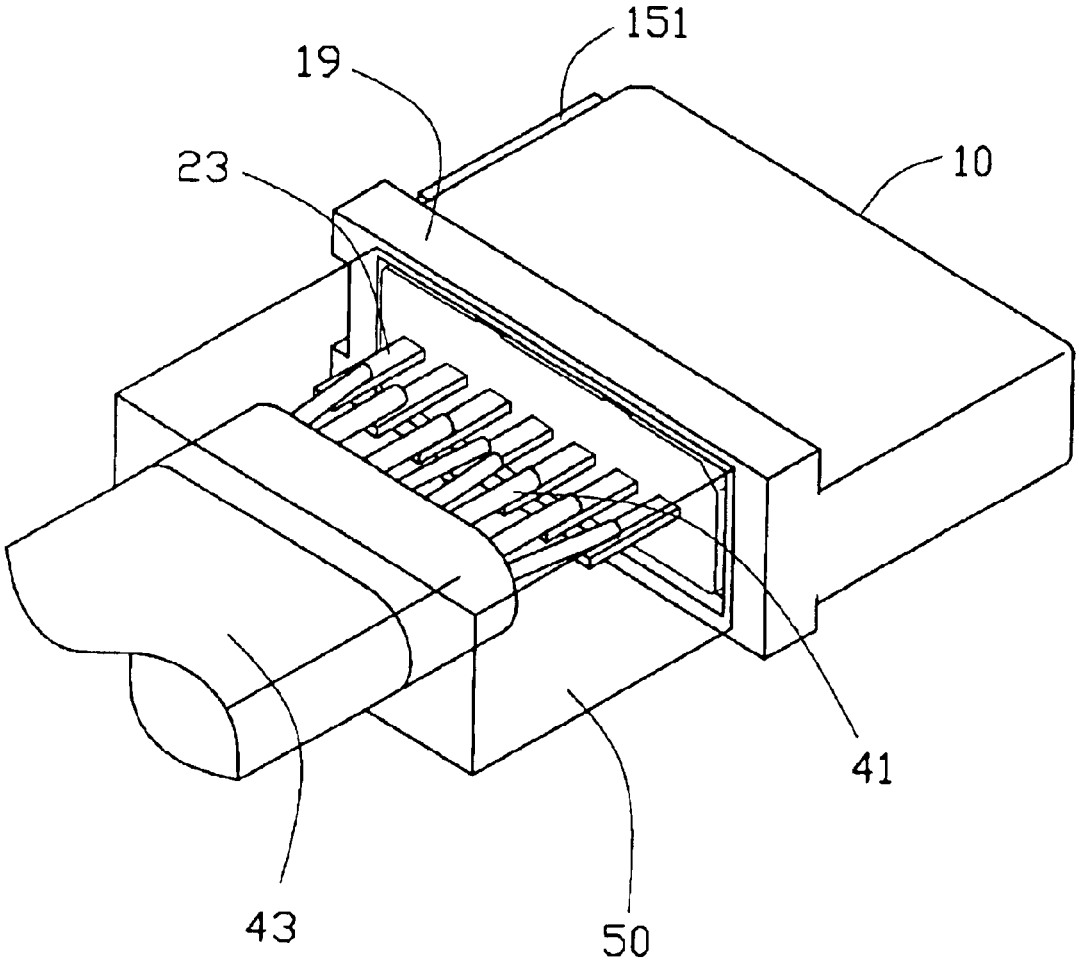
FIG. 6 is a view similar to FIG. 5, but the casing is molded with the connection area between the contacts and the cable.
Figure 7:
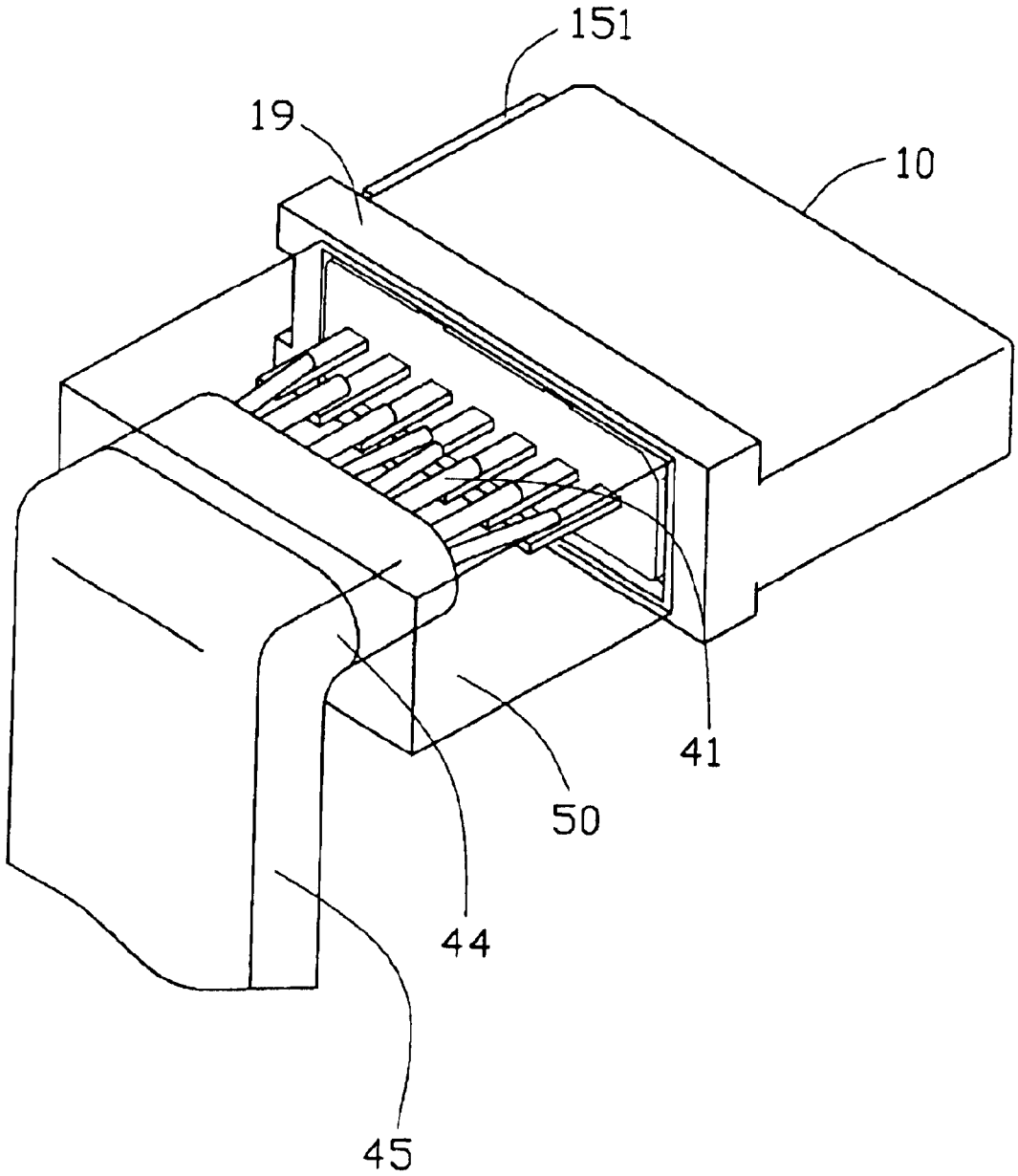
FIG. 7 is a view simnilar to FIG. 6, but the cable is bent downwardly along a rear edge of the casing.

Also referring to FIG. 5, the conductive cores 41 of the cable 40 are respectively soldered with the tail portions 23 of the contacts 20 for establishing an electrical connection therebetween. With reference to FIG. 6, the casing 50 is molded with the connection area between the contacts and the cable to ensure the connection reliable. The cable 40 is bent at a right angle with respect to a plane in which the insulative housing 10 is located along a rear edge of the casing 40. Returning to FIG. 2, the cover 60 is over-molded with the insulative housing 10, the casing 50, the horizontal section 44, and a part of the vertical section 45. The cover 60 engages with the ribs 19 for preventing it moving in a front-to-rear direction.

In the present invention, the cable 40 is arranged in such a way that the cable is bent at a right angle. By this arrangement, the contacts 20 need not to be angled, and the entire contact 20 plus the horizontal section 44 of the cable 40 will make the length of the cable end connector assembly 1 in the mating direction increase, whereby the cable end connector assembly 1 can be conveniently and readily mated/removed with/from the complementary connector. In addition, the housing 10 and the contacts 20 are used as original sizes, which can keep the production cost and the difficulty of assembling the contacts into the insulative housing at a lower level.

In alternative embodiments, the cable end connector assembly may need no casing, or the casing may be not at a desired length of the horizontal section of the cable. If so, an external tool, such as a rectangular block with a desired length, is required to assist the cable to be bent at a desired position. Therefore, the cable end connector assembly can get the same effects as obtained by the above embodiment. In addition, the cable may be bent at any other angle expect for the right angle as desired.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly comprising:

an insulative housing comprising a rear portion and defining a plurality of passageways therein;

a plurality of contacts received in the passageways, respectively;

a spacer assembled in the rear portion of the insulative housing for sealing the passageways, and comprising a plurality of openings defined therein for extension of the corresponding contacts therethrough and a protrusion snugly engaging with the insulative housing;

a cable comprising a first section electrically connected with the contacts and a second section extending at an angle with respect to the first section;

a cover over-molded with the rear portion of the insulative housing and the cable; and a casing molded with a connection area between the contacts and the first section of the cable and over-molded by the cover.

2. The cable end connector assembly as claimed in claim 1, wherein the second section of the cable is located outside of the casing and is partially over-molded by the cover.

3. The cable end connector assembly as claimed in claim 1, wherein the contacts and the first section of the cable both extend in a mating direction along which the cable end connector assembly is mated with a complementary connector.

4. The cable end connector assembly as claimed in claim 1, wherein the angle is 90 degrees, and wherein the second section of the cable is perpendicular to a plane in which the insulative housing is located.

5. The cable end connector assembly as claimed in claim 1, wherein the cable comprises a plurality of conductive cores electrically connected with the contacts respectively and an insulative jacket surrounding and separating the conductive cores.

6. The cable end connector assembly as claimed in claim 1, wherein the insulative housing comprises opposite top and bottom walls and opposite side walls, and wherein the top, bottom and side walls together define an L-shaped receiving space for receiving a complementary connector.

7. The cable end connector assembly as claimed in claim 1, wherein the insulative housing is formed with a plurality of ribs on outer faces of the rear portion thereof and enclosed by the cover.

8. A method for making a cable end connector assembly, comprising the steps of:

providing an insulative housing having a rear portion and comprising a plurality of passageways therein;

providing a plurality of contacts received in the passageways;

providing a spacer having a plurality of openings permitting the contacts to extend therethrough and a protrusion enraging with the insulative housing;

providing a cable having a plurality of conductive cores electrically connected with the contacts respectively and an insulative jacket surrounding and separating the conductive cores;

molding a casing with a connection area between the contacts and the cable;

bending the cable to form a first section connected with the contacts and a second section extending at an angle with respect to the first section; and over-molding a cover with the rear portion of the insulative housing, the casing and the cable.

9. The method as claimed in claim 8, wherein the bending step comprises bending the cable at a right angle along a rear end of the casing.

10. The method as claimed in claim 8, wherein the first section of the cable is entirely over-molded by the cover, and wherein the second section of the cable is partially over-molded by the cover.

11. A cable end connector comprising:

an insulative housing defining a lengthwise direction and a rear portion with a plurality of straight type tails of contacts extending rearward out of said rear portion;

a cable defining a cross-section essentially extending along said lengthwise direction, said cable including an outer jacket with a plurality of inner conductor forwardly exposed outside of said outer jacket and mechanically and electrically connected to the corresponding straight type tails, respectively, the outer jacket of said cable defining an angled section adjacent to the rear portion of the housing from a side view of said housing; and an insulative cover molded over and fully engaged with and supporting at least the said angled section of said outer jacket.

12. The connector as claimed in claim 11, wherein said cover further encloses the rear portion of the housing.

13. The connector as claimed in claim 12, further including an insulative casing molded over both the straight type tails of the contacts and only a horizontal section of the angled section of the outer jacket, wherein said casing is enclosed in said insulative cover.

* * * * *